US010740998B2

(12) United States Patent
Bogaki et al.

(10) Patent No.: US 10,740,998 B2
(45) Date of Patent: Aug. 11, 2020

(54) PAPER SHEET IDENTIFICATION DEVICE AND PAPER SHEET IDENTIFICATION METHOD

(71) Applicant: GLORY LTD., Himeji-shi, Hyogo (JP)

(72) Inventors: Akira Bogaki, Himeji (JP); Takahiro Yanagiuchi, Himeji (JP)

(73) Assignee: GLORY LTD., Hyogo (JP)

( * ) Notice: Subject to any disclaimer, the term of this patent is extended or adjusted under 35 U.S.C. 154(b) by 71 days.

(21) Appl. No.: 16/084,287

(22) PCT Filed: Mar. 9, 2017

(86) PCT No.: PCT/JP2017/009375

§ 371 (c)(1),
(2) Date: Sep. 12, 2018

(87) PCT Pub. No.: WO2017/159517

PCT Pub. Date: Sep. 21, 2017

(65) Prior Publication Data

US 2019/0080543 A1 Mar. 14, 2019

(30) Foreign Application Priority Data

Mar. 15, 2016 (JP) ..... 2016-050492
Mar. 9, 2017 (WO) ..... PCT/JP2017/009375

(51) Int. Cl.
*G07D 7/121* (2016.01)
*G07D 7/00* (2016.01)
(Continued)

(52) U.S. Cl.
CPC ..... *G07D 7/121* (2013.01); *G07D 7/00* (2013.01); *G07D 7/128* (2013.01); *G07D 7/183* (2017.05)

(58) Field of Classification Search
CPC ..... G07D 7/121; G07D 7/00; G07D 7/128; G07D 7/183; G07D 7/12; G07D 7/1205;
(Continued)

(56) References Cited

U.S. PATENT DOCUMENTS 4,352,988 A * 10/1982 Ishida ..... G07D 7/00 250/559.11
5,576,825 A * 11/1996 Nakajima ..... G06K 9/2036 356/71
(Continued)

FOREIGN PATENT DOCUMENTS

CN 1685373 A 10/2005
CN 104573700 A 4/2015
(Continued)

OTHER PUBLICATIONS

English translation of WO-2014178129-A1 from Espacenet.*

*Primary Examiner* — Mohamed K Amara
(74) *Attorney, Agent, or Firm* — Renner, Kenner, Greive, Bobak, Taylor & Weber

(57) ABSTRACT

A paper sheet recognition apparatus can generate a subtracted reflective light image without increasing detection time. To that end, the operations of sensors are controlled in a plurality of phases. The phases include a phase (reflected infrared light 1) in which a first light emission unit emits light, a second light emission unit emits no light, and an optical sensor detects reflective light. In another phase, (reflected infrared light 2) the first light emission unit emits no light, the second light emission unit emits light, and the optical sensor detects reflective light. In at least one of these phases, a light emission unit emits light, and an optical sensor detects transmissive light.

11 Claims, 6 Drawing Sheets

(51) Int. Cl.
*G07D 7/183* (2016.01)
*G07D 7/128* (2016.01)

(58) Field of Classification Search
CPC ... G07D 7/187; G07D 7/17; G01J 1/04; G01J 1/0437; G01J 1/047; G06T 2207/30168; G06T 7/0002; G06T 7/40; G06T 7/90; H04N 1/04; H04N 1/486; H04N 5/2256
See application file for complete search history.

(56) References Cited

U.S. PATENT DOCUMENTS 6,242,733 B1 * 6/2001 Ma ..... B65H 7/125 235/462.17
6,354,507 B1 * 3/2002 Maeda ..... G07D 7/20 235/454
6,486,464 B1 * 11/2002 Ma ..... B65H 7/125 250/223 R
6,744,525 B2 * 6/2004 Goltsos ..... B07C 5/3412 356/614
7,349,075 B2 * 3/2008 Fujimoto ..... G07D 7/12 250/556
7,742,154 B2 6/2010 Ehrich et al.
7,859,726 B2 * 12/2010 Endo ..... G07D 7/121 358/474
8,107,712 B2 * 1/2012 Holl ..... G07D 7/121 356/71
8,300,916 B2 * 10/2012 Strong ..... G07D 7/1205 356/71
8,937,743 B1 * 1/2015 Kasuya ..... H04N 1/482 358/1.2
9,947,162 B2 * 4/2018 Bogaki ..... G07D 7/121
2003/0210386 A1 * 11/2003 Laskowski ..... G07D 7/12 356/71
2005/0244046 A1 11/2005 Yamamoto
2005/0276458 A1 * 12/2005 Jones ..... G06Q 20/18 382/135
2008/0273789 A1 * 11/2008 Bell ..... G07D 7/17 382/137
2009/0022390 A1 * 1/2009 Yacoubian ..... G07D 11/50 382/135
2010/0102234 A1 * 4/2010 Hamasaki ..... G07D 7/121 250/341.7
2011/0052085 A1 * 3/2011 Ikari ..... G07D 7/12 382/224
2011/0064279 A1 3/2011 Uno
2015/0213620 A1 7/2015 Ikemoto et al.
2016/0070947 A1 * 3/2016 Bogaki ..... G07D 7/121 356/71
2016/0307060 A1 * 10/2016 Aiello ..... G07D 7/12
2017/0153184 A1 * 6/2017 Bogaki ..... G01N 21/64
2017/0276543 A1 9/2017 Bogaki et al.
2018/0268634 A1 9/2018 Liu et al.

FOREIGN PATENT DOCUMENTS

CN 104916036 A 9/2015
EP 2 166 515 A1 3/2010
EP 2 993 648 A1 3/2016
JP 2004-083239 A 3/2004
JP 2014-29301 A 2/2014
WO WO-2014178129 A1 * 11/2014 ..... G01N 21/55

* cited by examiner

PAPER SHEET IDENTIFICATION DEVICE AND PAPER SHEET IDENTIFICATION METHOD

TECHNICAL FIELD

The present disclosure relates to a paper sheet recognition apparatus for recognizing paper sheets such as banknotes.

BACKGROUND ART

Patent Document 1 discloses an apparatus which alternately irradiates paper sheets being transported with rays of light emitted in different directions from two light sources, and takes two images at the timings of irradiation. In this apparatus, the two images thus obtained are summed into an image, based on which it is determined whether each paper sheet is genuine or not, and of which denomination the paper sheet is. Further, one of the two images is subtracted from the other to obtain an image, based on which it is determined how much the paper sheet is wrinkled.

CITATION LIST

Patent Document

[Patent Document 1] U.S. Pat. No. 7,742,154

SUMMARY OF THE INVENTION

Technical Problem

A common paper sheet recognition apparatus includes a line sensor configured to obtain reflective light images of both faces of each paper sheet being transported and a transmissive light image of the paper sheet. Specifically, a single operation cycle is divided into a plurality of phases, and light emission units to emit light and optical sensors to be operated are changed for each phase. Through repeating this operation cycle multiple times while the paper sheets are being transported, image data forming various images are obtained.

In this configuration, suppose that a subtracted reflective light image as disclosed by Patent Document 1 is obtained to determine how much the paper sheet is wrinkled, for example. In this case, the operation cycle needs to have an additional phase for alternately emitting rays of light in different directions from two light sources to obtain two images, which are required to generate the subtracted reflective light image.

In such a case, however, operation time per cycle increases. Therefore, in order to obtain various images as high resolution as those obtained by a common apparatus, longer detection time is required. In addition, transport speed needs to be lowered. This is not advantageous in view of the handling performance of the paper sheet recognition apparatus.

In view of the foregoing, the present disclosure aims to provide a paper sheet recognition apparatus which can generate a subtracted reflective light image without increase in the detection time and decrease in the transport speed.

Solution to the Problem

Disclosed herein is a paper sheet recognition apparatus for recognizing paper sheets. The apparatus includes: a transport path on which paper sheets are transported; a first sensor which is opposed to one of faces of each paper sheet being transported, and performs detection in a first recognition zone of the transport path; a second sensor which is opposed to the other face of each paper sheet being transported, and performs detection in a second recognition zone of the transport path; and a sensor controller which controls the first and second sensors. The first sensor includes a first light emission unit and a second light emission unit which emit rays of light from mutually different directions to the first recognition zone, a first optical sensor which detects light reflected from the paper sheet in the first recognition zone, and a third light emission unit which emits light to the second recognition zone. The second sensor includes a second optical sensor which detects light transmitted through the paper sheet in the second recognition zone. The sensor controller controls operations of the first and second sensors, the operations being divided into a plurality of phases. The plurality of phases includes a first phase in which the first light emission unit emits light, the second light emission unit emits no light, and the first optical sensor detects reflective light, and a second phase in which the first light emission unit emits no light, the second light emission unit emits light, and the first optical sensor detects reflective light. In at least one of the first phase or the second phase, the third light emission unit emits light, and the second optical sensor detects transmissive light.

In this configuration, in at least one of the first phase or the second phase in which one of the first and second light emission units of the first sensor emits light and the first optical sensor detects light reflected from the paper sheet, the third light emission unit of the first sensor emits light and the second optical sensor of the second sensor detects light transmitted through the paper sheet. Thus, the light reflected as a result of light emission from a single light emission unit (will be hereinafter referred to as "single light emission"), the light being required for the generation of a subtracted reflective light image used to recognize how much the paper sheet is wrinkled, can be detected simultaneously with the detection of the transmissive light. This can avoid the detection time from increasing, and the transport speed from decreasing.

Further, in this configuration, the third light emission unit may be able to emit rays of light of different wavelengths, and the sensor controller may allow the third light emission unit to emit rays of light of mutually different wavelengths in the first and second phases, and allow the second optical sensor to detect transmissive light.

Thus, in the first and second phases in which the light reflected as a result of the single light emission is detected, transmitted rays of light of different wavelengths, such as infrared light and visible light, can be detected.

Further, in this configuration, the apparatus may further include an image data generator unit which generates an image of the paper sheet from outputs of the first and second sensors, wherein the image data generator unit generates a first reflective light image from the output of the first sensor in the first phase and a second reflective light image from the output of the first sensor in the second phase, and generates a subtracted reflective light image from a difference between the first reflective light image and the second reflective light image.

Thus, the first and second reflective light images are generated respectively from the outputs of the first sensor in the first and second phases, and the image data generator generates a subtracted reflective light image, which is used to recognize how much the paper sheet is wrinkled, for example, from a difference between the first and second reflective light images.

In this configuration, the second sensor may further include a fourth light emission unit and a fifth light emission unit which emit rays of light in mutually different directions to the second recognition zone, and the plurality of phases may include a third phase in which the first and second light emission units emit light and the first optical sensor detects reflective light, and the fourth and fifth light emission units emit light and the second optical sensor detects reflective light.

Thus, the light reflected from each of the faces of the paper sheet can be detected in the third phase.

In this configuration, each of the first and second light emission units may include a light guide extending in a principal scanning direction of the first optical sensor, and illuminators respectively provided at ends of the light guide, the first and second light emission units being arranged in parallel with each other.

Thus, the light emission units which emit light uniformly in the principal scanning direction of the first optical sensor can be provided with a simple structure.

In this configuration, each of the first and second light emission units may include a light guide extending in a principal scanning direction of the first optical sensor, and an illuminator provided at one of ends of the light guide, the first and second light emission units being arranged in parallel with each other, and the illuminators being arranged at the ends on the same side of the light guides.

Thus, the light emission units which emit light uniformly in the principal scanning direction of the first optical sensor can be achieved with a simple structure and a small number of illuminators. In addition, a subtracted infrared light image can be obtained more sharply.

In this configuration, each of the first and second light emission units may include a light guide extending in a principal scanning direction of the first optical sensor, and an illuminator provided at one of ends of the light guide, the first and second light emission units being arranged in parallel with each other, and the illuminators being arranged at the ends on different sides of the light guides.

Thus, the light emission units which emit light uniformly in the principal scanning direction of the first optical sensor can be achieved with a simple structure and a small number of illuminators. Further, the light emission units can be installed even if the installation location has spatial limitations.

In this configuration, the paper sheet recognition apparatus may further include a light emission circuit controlling timing and amount of light emission from each of the first and second light emission units, wherein the light emission circuit includes a first circuit which drives the first light emission unit when the first light emission unit emits light and the second light emission unit emits no light, and a second circuit which drives the second light emission unit when the first light emission unit emits no light and the second light emission unit emits light, and a third circuit which is independent from the first and second circuits, and drives the first and second light emission units when both of the first and second light emission units emit light.

Thus, if one of the first or second light emission units is allowed to emit light, the first or second circuit drives the one of the light emission units. If both of the first and second light emission units are allowed to emit light, the third circuit, which is independent from the first and second circuits, drives the first and second light emission units. Thus, in either case, the amount of light emitted can be controlled appropriately. The control can be performed in the following manner. For example, if one of the first or second light emission units is allowed to emit light, the amount of light emitted from the one of the light emission units is increased, and if both of the first and second light emission units are allowed to emit light, the amount of light emitted from each light emission unit is somewhat reduced.

In this configuration, the first and second light emission units may emit infrared light in the first and second phases.

With use of the infrared light, the detection of wrinkles, for example, can be less influenced by smudges on the paper sheet. Even if a pattern that is invisible under the infrared light is printed on the paper sheet, the detection can also be less influenced by such a pattern.

In this configuration, the paper sheets may be banknotes, for example.

The present disclosure also relates to a method for recognizing paper sheets using a paper sheet recognition apparatus. The paper sheet recognition apparatus includes: a first sensor which is opposed to one of faces of each paper sheet being transported on a transport path for transporting the paper sheets, and performs detection in a first recognition zone of the transport path; and a second sensor which is opposed to the other face of each paper sheet being transported on the transport path, and performs detection in a second recognition zone of the transport path. The first sensor includes a first light emission unit and a second light emission unit which emit rays of light in mutually different directions to the first recognition zone, a first optical sensor which detects light reflected from the paper sheet in the first recognition zone, and a third light emission unit which emits light to the second recognition zone. The second sensor includes a second optical sensor which detects light transmitted through the paper sheet in the second recognition zone. The method includes: a first step of allowing the first light emission unit to emit light, the second light emission unit to emit no light, and the first optical sensor to detect reflective light; a second step of allowing the first light emission unit to emit no light, the second light emission unit to emit light, and the first optical sensor to detect reflective light; and a third step of allowing the third light emission unit to emit light, and the second optical sensor to detect transmissive light, the third step being performed simultaneously with at least one of the first step or the second step.

In this configuration, simultaneously with at least one of the first step or the second step in which one of the first or second light emission units of the first sensor emits light and the first optical sensor detects light reflected from the paper sheet, the third light emission unit of the first sensor emits light and the second optical sensor of the second sensor detects light transmitted through the paper sheet. Thus, the light reflected as a result of the single light emission, which is required for the generation of a subtracted reflective light image used to recognize how much the paper sheet is wrinkled, can be detected simultaneously with the detection of the transmissive light. This can avoid the detection time from increasing, and the transport speed from decreasing.

Advantages of the Invention

The present disclosure can provide a paper sheet recognition apparatus which can generate a subtracted reflective light image while avoiding the detection time from increasing and the transport speed from decreasing.

DESCRIPTION OF EMBODIMENTS

Embodiments of a paper sheet recognition apparatus will be described in detail below with reference to the drawings. The paper sheet may be a banknote, for example, and the paper sheet recognition apparatus described below recognizes various characteristics of the paper sheet, for example, of which denomination the banknote is, whether the banknote is genuine or not, fit or unfit, and how much the banknote is wrinkled. In addition to the banknotes, the apparatus can also recognize other paper sheets such as checks, bills of exchange, and vouchers.

Figure 1:
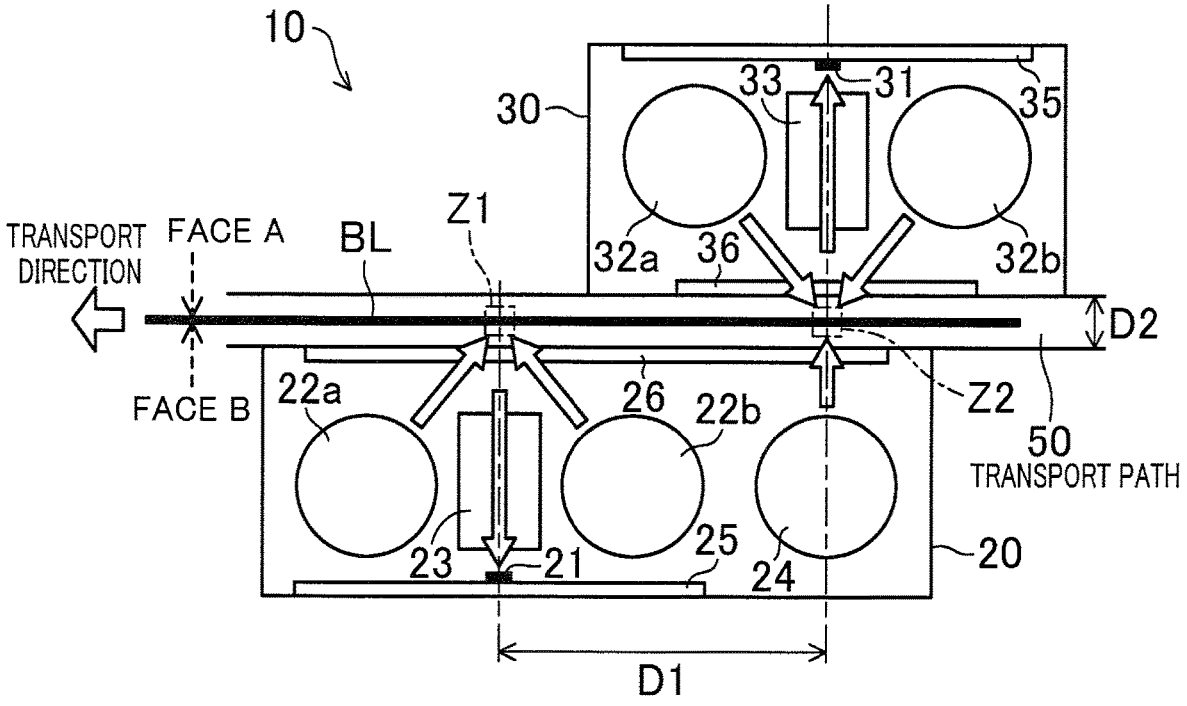
FIG. 1 illustrates an exemplary configuration of a line sensor of a paper sheet recognition apparatus.

FIG. 1 illustrates an exemplary configuration of a line sensor 10 of the paper sheet recognition apparatus. In the configuration of FIG. 1, paper sheets BL are transported one by one on a transport path 50 from the right to the left in FIG. 1 with their faces being parallel to the horizontal direction. FIG. 1 is a cross-sectional view taken along a plane perpendicular to the faces of the paper sheets BL and parallel to the direction of transport of the paper sheets BL.

As shown in FIG. 1, the line sensor 10 includes a first sensor 20 which is opposed to one of the faces (face B) of the paper sheet BL, and a second sensor 30 which is opposed to the other face (face A) of the paper sheet BL. The first and second sensors 20 and 30 face each other with the transport path 50 interposed therebetween. In FIG. 1, the first sensor 20 is arranged below the transport path 50, and the second sensor 30 is arranged above the transport path 50. However, their positions are not limited thereto, and may be reversed in the vertical direction. For example, if the transport path 50 is arranged to extend in the vertical direction, the first and second sensors 20 and 30 may be arranged on the right and left of the transport path 50.

The first sensor 20 performs detection in a recognition zone Z1 (first recognition zone) of the transport path 50, and includes an optical sensor 21 (first optical sensor), light emission units 22*a* and 22*b* (first and second light emission units), a condenser lens 23, another light emission unit 24 (third light emission unit), an optical sensor substrate 25, and a transparent member 26 made of transparent glass or resin. The second sensor 30 performs detection in a recognition zone Z2 (second recognition zone) of the transport path 50, and includes an optical sensor 31 (second optical sensor), light emission units 32*a* and 32*b* (fourth and fifth light emission units), a condenser lens 33, an optical sensor substrate 35, and a transparent member 36 made of transparent glass or resin.

The light emission units 22*a* and 22*b* of the first sensor 20 emit rays of light in mutually different directions onto the recognition zone Z1. In this example, the face of the paper sheet BL being transported is irradiated with light traveling obliquely rearward from the light emission unit 22*a*, and light traveling obliquely forward from the light emission unit 22*b*. The optical sensor 21 detects light reflected from the paper sheet BL in the recognition zone Z1. Specifically, the light emitted from each of the light emission units 22*a* and 22*b* is applied to the paper sheet BL through the transparent member 26, and light reflected from the paper sheet BL is concentrated by the condenser lens 23 and detected by the optical sensor 21. The light emission unit 24 emits light onto the recognition zone Z2. In this example, the light emission unit 24 emits the light traveling in the vertical direction to the face of the paper sheet BL being transported.

The optical sensor 31 of the second sensor 30 detects light transmitted through the paper sheet BL in the recognition zone Z2. Specifically, the optical sensor 31 can detect light that has been emitted from the light emission unit 24 of the first sensor 20 and transmitted through the paper sheet BL. The light emission units 32*a* and 32*b* emit rays of light in mutually different directions onto the recognition zone Z2. In this example, the face of the paper sheet BL being transported is irradiated with light traveling obliquely rearward from the light emission unit 32*a*, and light traveling obliquely forward from the light emission unit 32*b*. The optical sensor 31 also detects light reflected from the paper sheet BL in the recognition zone Z2. Specifically, the light emitted from each of the light emission units 32*a* and 32*b* is applied to the paper sheet BL through the transparent member 36, and the light reflected from the paper sheet BL is concentrated by the condenser lens 33 and detected by the optical sensor 31.

The optical sensors 21 and 31 are line sensors, and perform scanning in a principal scanning direction which is parallel to the face of the paper sheet BL and perpendicular to the transport direction of the paper sheet BL (a direction coming out of the paper of FIG. 1). About 1,600 pixel units, for example, are arranged side by side in the principal scanning direction. The light emission units 22*a*, 22*b*, 24, 32*a*, and 32*b* extend in the same direction as the principal scanning direction of the optical sensors 21 and 31. In this example, the light emission units 22*a*, 22*b*, 24, 32*a*, and 32*b* can emit, for example, two types of light of different wavelengths, e.g., green visible light and infrared light.

Figure 2A:
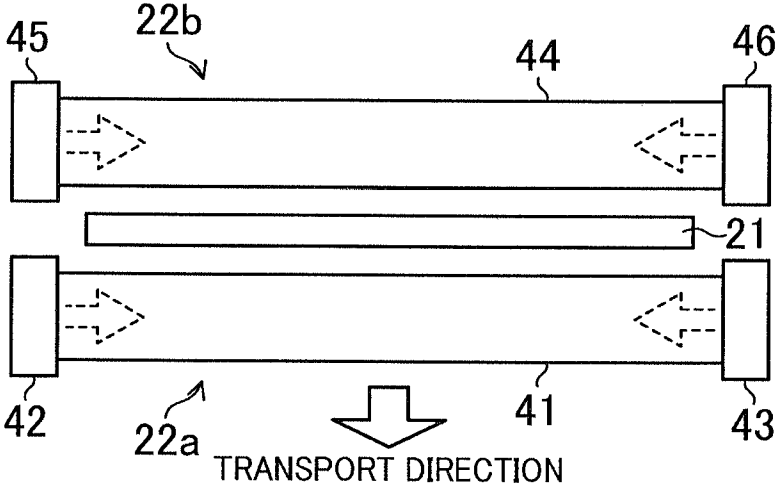
FIGS. 2A, 2B, 2C, and 2D illustrate an exemplary configuration of a light emission unit.

FIG. 2A is a schematic plan view illustrating an exemplary configuration of the light emission units 22*a* and 22*b*. In the configuration of FIG. 2A, the light emission units 22*a* and 22*b* are arranged in parallel with each other. The light emission unit 22*a* includes a light guide 41 extending in the principal scanning direction of the optical sensor 21, and illuminators 42 and 43 respectively provided at the ends of the light guide 41. The light emission unit 22*b* includes a light guide 44 extending in the principal scanning direction of the optical sensor 21, and illuminators 45 and 46 respectively provided at the ends of the light guide 44. Each of the illuminators 42, 43, 45, and 46 is provided with a light source, e.g., LED, and emits light toward the light guide 41 or 44 as indicated by arrows in the drawings. Thus, the light guides 41 and 44 are uniformly illuminated with light of the same wavelength as the light emitted by the illuminators 42, 43, 45, and 46.

Figure 2B:
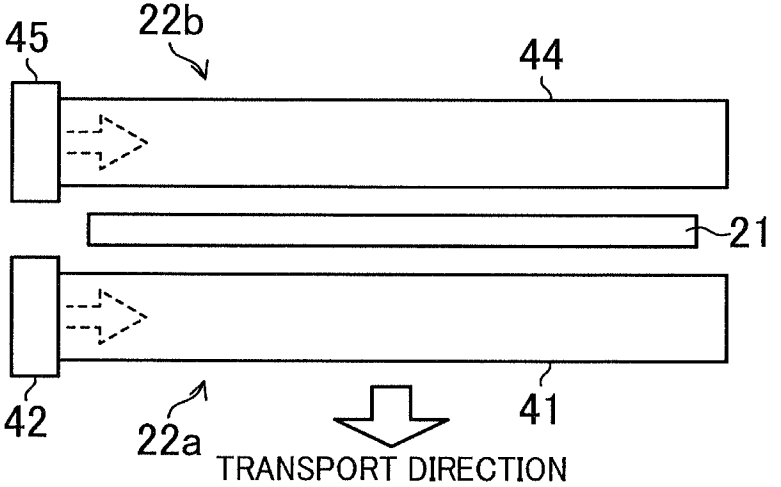
Figure 2C:
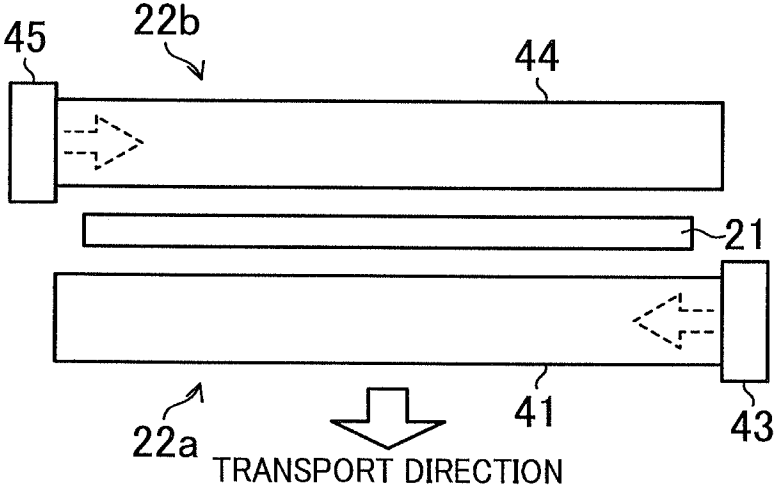
Figure 2D:
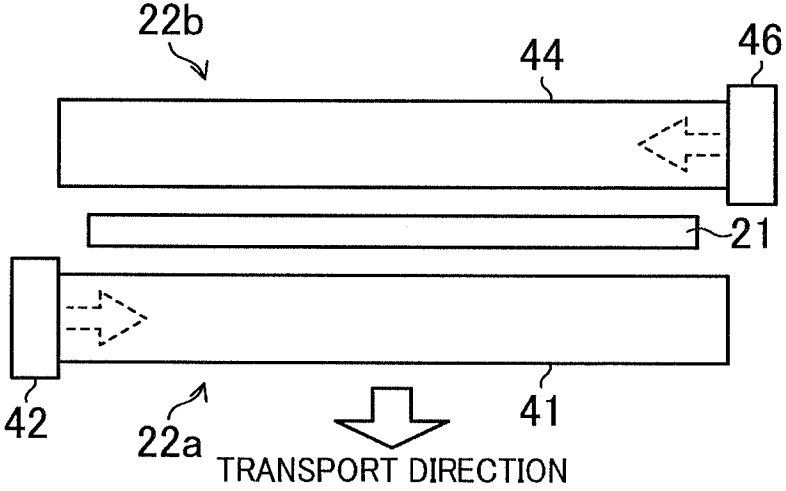

As shown in FIG. 2B, the illuminators 42 and 45 may be respectively provided at one of the ends of the light guide 41 and one of the ends of the light guide 44. In this case, it is preferred that in the pair of light emission units 22*a* and 22*b*, the illuminators 42 and 45 be provided at the ends on the same side of the light guides 41 and 44. In this configuration, a subtracted infrared light image, which will be described later, can be obtained with enhanced sharpness. Further, the subtracted infrared light image can also be obtained even if the illuminators 42 and 45 or the illuminators 42 and 46 are arranged at the ends on the opposite sides of the light guides 41 and 44 as shown in FIGS. 2C and 2D due to spatial limitations on the installation location, for example. Alternatively, the light emission units 22*a* and 22*b* may be made of LED arrays, for example. Other light emission units 24, 32*a*, and 32*b* can be configured in the same manner as the light emission units 22*a* and 22*b*.

Figure 3:
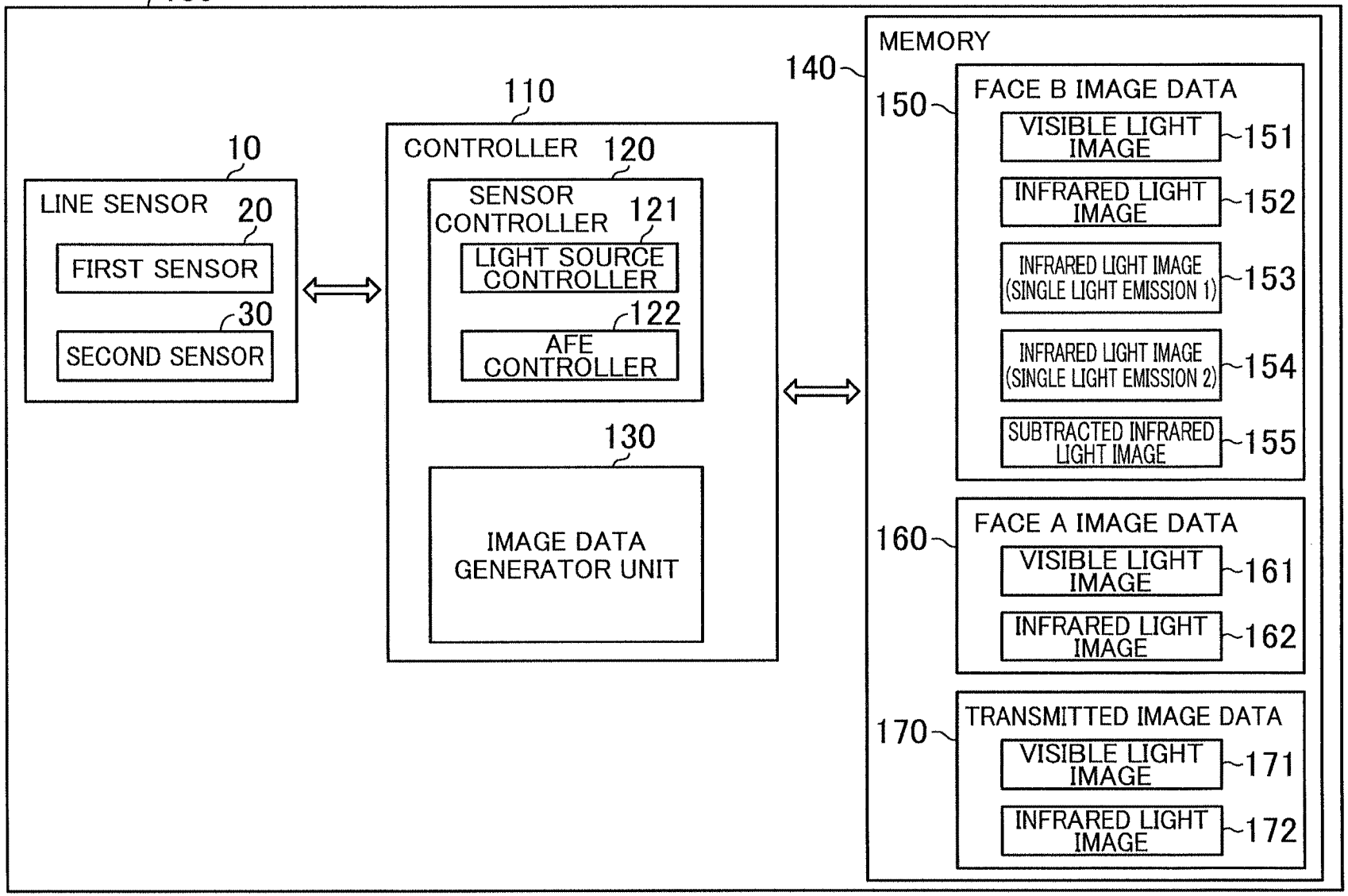
FIG. 3 is a block diagram illustrating principal components of the paper sheet recognition apparatus.

FIG. 3 is a block diagram illustrating principal components of the paper sheet recognition apparatus according to the embodiment. A paper sheet recognition apparatus 100 includes the line sensor 10 shown in FIG. 1, a controller 110 controlling the whole paper sheet recognition apparatus 100, and a memory 140 storing data, such as image data obtained by the line sensor 10.

The controller 110 includes a sensor controller 120 controlling the operation of the line sensor 10, and including a light source controller 121 and an AFE controller 122. The light source controller 120 performs ON/OFF control of light sources of the light emission units 22*a*, 22*b*, 24, 32*a*, and 32*b* provided for the line sensor 10. The AFE controller 122 performs various types of processing with respect to an analog front end (AFE) of the line sensor 10, such as offset adjustment, setting of input signal sampling, control of timing of data extraction, and setting of data output.

An image data generator unit 130 generates various types of image data from the output of the line sensor 10, and stores the data in the memory 140. The image data generator unit 130 generates, from the output of the first sensor 20, visible light image data 151 and infrared light image data 152 as face B image data 150. The visible light image data 151 is generated from a signal output from the optical sensor 21 when each of the light emission units 22*a* and 22*b* emitted visible light. The infrared light image data 152 is generated from a signal output from the optical sensor 21 when each of the light emission units 22*a* and 22*b* emitted infrared light. Further, the image data generator unit 130 generates infrared light image data 153 (first reflective light image) from a signal output from the optical sensor 21 when the light emission unit 22*a* emitted infrared light and the light emission unit 22*b* emitted no light. The image data generator unit 130 also generates infrared light image data 154 (second reflective light image) from a signal output from the optical sensor 21 when the light emission unit 22*a* emitted no light and the light emission unit 22*b* emitted infrared light. Then, based on a difference between the infrared light image data 153 and 154, subtracted infrared light image data 155 (subtracted reflective light image) is generated.

The image data generator unit 130 generates, from the output of the second sensor 30, visible light image data 161 and infrared light image data 162 as face A image data 160. The visible light image data 161 is generated from the signal output from the optical sensor 31 when the light emission units 32*a* and 32*b* emitted visible light. The infrared light image data 162 is generated from the signal output from the optical sensor 31 when the light emission units 32*a* and 32*b* emitted infrared light. The image data generator unit 130 generates, from the output of the second sensor 30, visible light image data 171 and infrared light image data 172 as transmissive image data 170. The visible light image data 171 is generated from the signal output from the optical sensor 31 when the light emission unit 24 of the first sensor 20 emitted visible light. The infrared light image data 172 is generated from the signal output from the optical sensor 31 when the light emission unit 24 emitted infrared light.

With use of the visible light image data 151, 161, and 171, and the infrared light image data 152, 162, and 172, the paper sheet BL is recognized in terms of, for example, types and genuineness. Further, with use of the subtracted infrared light image data 155, how much the paper sheet BL is wrinkled or creased can be detected. Specifically, the light emission units 32*a* and 32*b*, which emit rays of light in mutually different directions, are allowed to emit light in turn so that reflective light images are generated, and a difference between these images is obtained. As a result, an image of patterns or characters provided on the paper sheet BL is canceled, and the wrinkles or creases of the paper sheet BL are enhanced on the image. In this way, how much the paper sheet BL is wrinkled or creased can be detected using the subtracted infrared light image data 155. With use of the infrared light, the detection can be less influenced by smudges on the paper sheet BL. Some paper sheets BL have a printed pattern that is invisible under the infrared light. Therefore, if the infrared light is used, the wrinkles or creases may be detected on an image, of the paper sheet BL, less influenced by such pattern.

Figure 4:
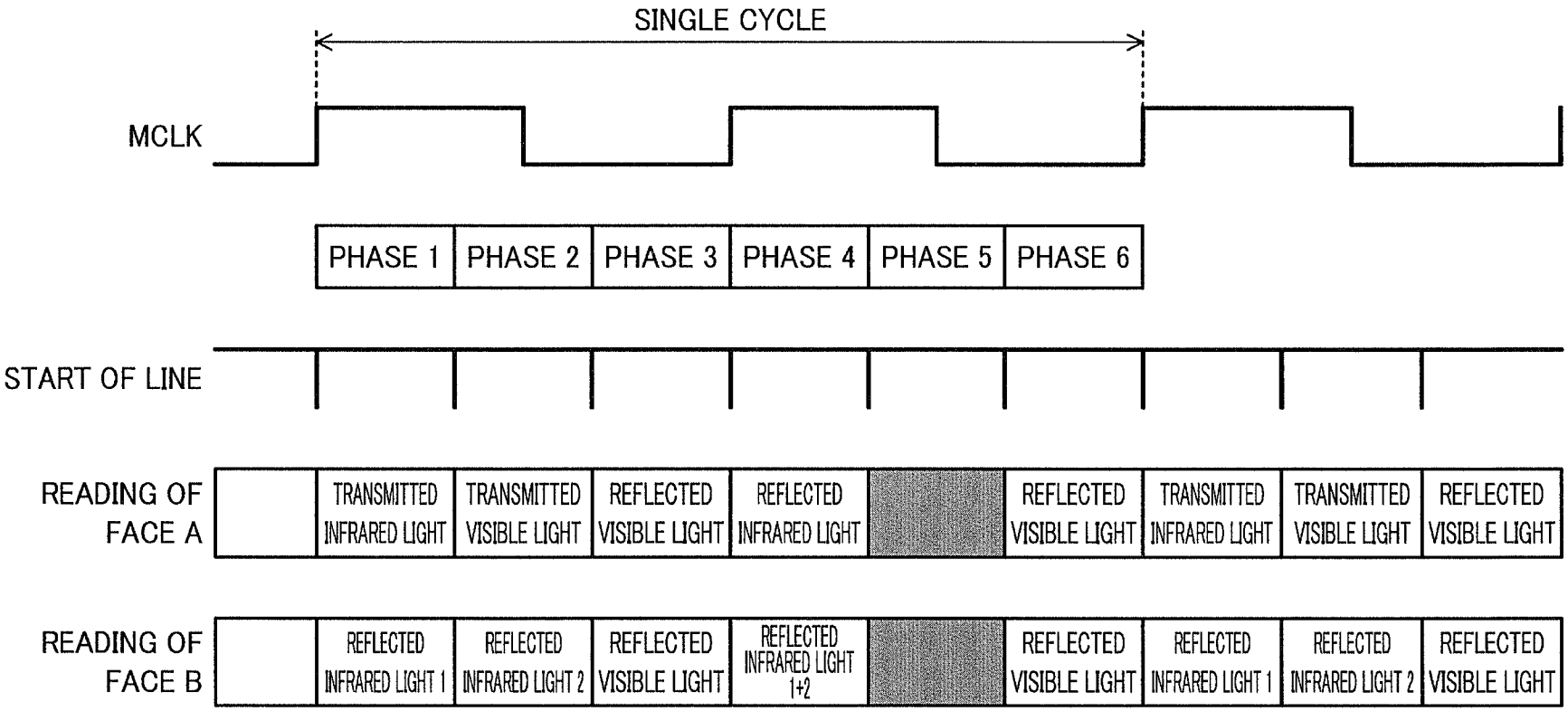
FIG. 4 is a timing chart illustrating how the line sensor is operated.
Figure 5:
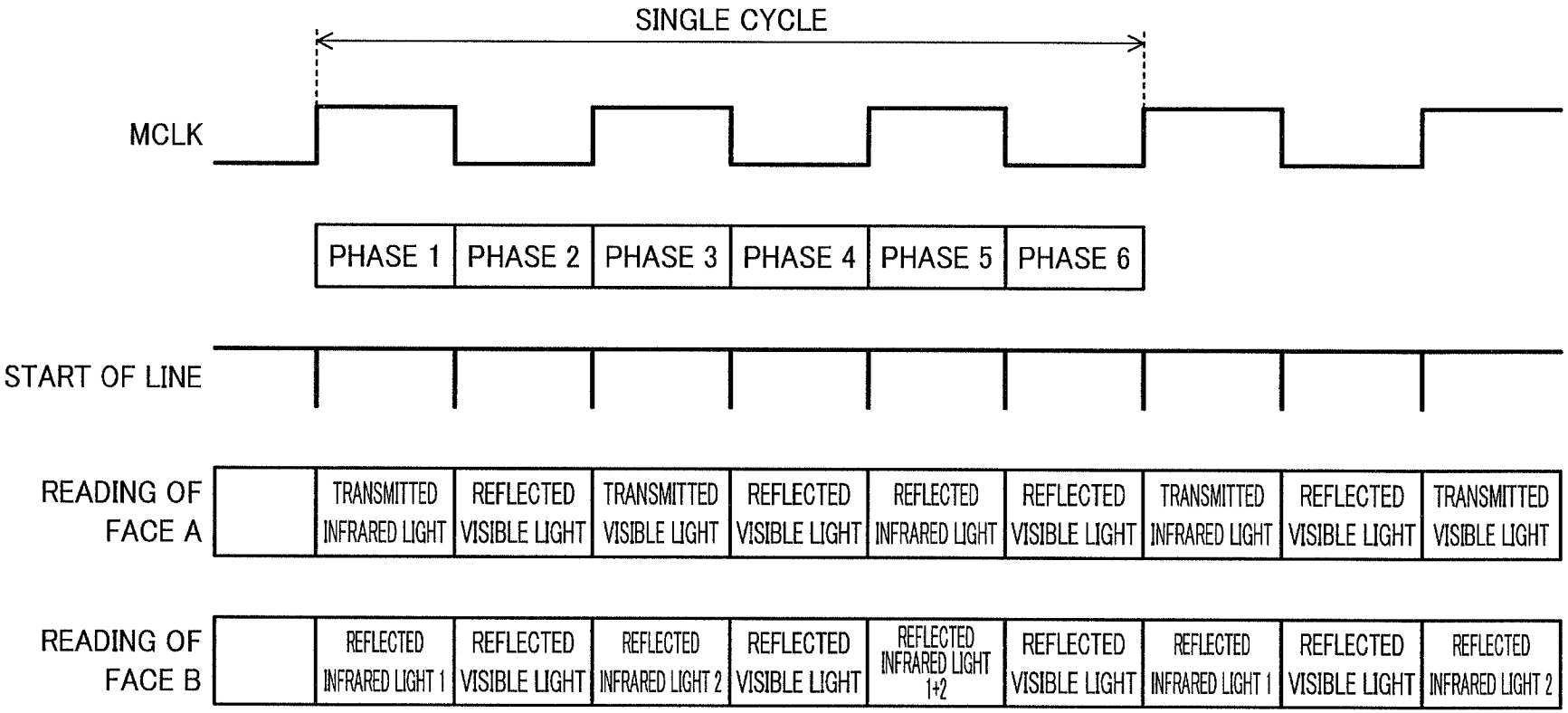
FIG. 5 is a timing chart illustrating how the line sensor is operated.

FIGS. 4 and 5 are timing charts illustrating how the line sensor 10 is operated. The line sensor 10 repeats the operation shown in FIGS. 4 and 5 in multiple cycles when the paper sheet BL is transported on the transport path 50. In FIGS. 4 and 5, "MCLK" stands for a mechanical clock of the paper sheet recognition apparatus 100. "Reading of face A" is performed by the second sensor 30, and "Reading of face B" is performed by the first sensor 20.

In the example of FIG. 4, two cycles of the mechanical clock MCLK are regarded as a single cycle, which is divided into six phases to perform operations. In Phase 1, the light emission unit 22*a* emits the infrared light, the light emission unit 22*b* emits no light, and the optical sensor 21 detects light reflected from the paper sheet BL (reading of face B: reflected infrared light 1). Further, the light emission unit 24 emits the infrared light, and the optical sensor 31 detects light transmitted through the paper sheet BL (reading of face A: transmitted infrared light). In Phase 2, the light emission unit 22*a* emits no light, the light emission unit 22*b* emits the infrared light, and the optical sensor 21 detects light reflected from the paper sheet BL (reading of face B: reflected infrared light 2). In addition, the light emission unit 24 emits the visible light, and the optical sensor 31 detects light transmitted through the paper sheet BL (reading of face A: visible light transmission).

In Phase 3, the light emission units 22*a* and 22*b* emit the visible light, and the optical sensor 21 detects light reflected from the paper sheet BL (reading of face B: reflected visible light). Further, the light emission units 32*a* and 32*b* emit the visible light, and the optical sensor 31 detects light reflected from the paper sheet BL (reading of face A: reflected visible light). In Phase 4, the light emission units 22*a* and 22*b* emit the infrared light, and the optical sensor 21 detects light reflected from the paper sheet BL (reading of face B: reflected infrared light 1+2). Further, the light emission units 32*a* and 32*b* emit the infrared light, and the optical sensor 31 detects light reflected from the paper sheet BL (reading of face A: reflected infrared light). In Phase 5, no operation is performed. In Phase 6, the same operation as in Phase 3 is performed.

Through the operations thus performed, two-line image data of the visible light reflected from the face A, two-line image data of the visible light reflected from the face B, single-line image data of the infrared light reflected from each of the faces A and B, single-line image data of the transmitted infrared light, and single-line image data of the transmitted visible light, are obtained in a single cycle. In addition, single-line image data of the light reflected from the face B as a result of the single light emission can be obtained in each of Phases 1 and 2. These two single-line image data are required for the generation of a subtracted reflective light image.

Note that in Phases 1 and 2, the first sensor 20 detects the light reflected from the face B as a result of the single light emission, and the second sensor 30 detects transmissive light. Specifically, the phase for obtaining the transmissive light image is used to obtain the image of the light reflected from the face B as a result of the single light emission. That is, no additional phase is required. Therefore, the subtracted reflective light image, which is used for the detection of the wrinkles, can be generated without increasing the detection time and decreasing the resolution of other transmissive light images and reflective light images.

In the example of FIG. 5, three cycles of the mechanical clock MCLK are regarded as a single cycle, which is divided into six phases to perform the operations. In Phase 1, the light emission unit 22*a* emits the infrared light, the light emission unit 22*b* emits no light, and the optical sensor 21 detects light reflected from the paper sheet BL (reading of face B: reflected infrared light 1). Further, the light emission unit 24 emits the infrared light, and the optical sensor 31 detects light transmitted through the paper sheet BL (reading of face A: transmitted infrared light). In Phase 2, the light emission units 22*a* and 22*b* emit the visible light, and the optical sensor 21 detects light reflected from the paper sheet BL (reading of face B: reflected visible light). Further, the light emission units 32*a* and 32*b* emit the visible light, and the optical sensor 31 detects light reflected from the paper sheet BL (reading of face A: reflected visible light). In Phase 3, the light emission unit 22*a* emits no light, the light emission unit 22*b* emits infrared light, and the optical sensor 21 detects light reflected from the paper sheet BL (reading of face B: reflected infrared light 2). In addition, the light emission unit 24 emits the visible light, and the optical sensor 31 detects light transmitted through the paper sheet BL (reading of face A: visible light transmission).

In Phase 4, the same operation as in Phase 2 is performed. In Phase 5, the light emission units 22*a* and 22*b* emit the infrared light, and the optical sensor 21 detects light reflected from the paper sheet BL (reading of face B: reflected infrared light 1+2). Further, the light emission units 32*a* and 32*b* emit the infrared light, and the optical sensor 31 detects light reflected from the paper sheet BL (reading of face A: reflected infrared light). In Phase 6, the same operation as in Phase 2 is performed.

Through the operation thus performed, three-line image data of the visible light reflected from the face A, three-line image data of the visible light reflected from the face B, single-line image data of the infrared light reflected from each of the faces A and B, single-line image data of the transmitted infrared light, and single-line data of the transmitted visible light, are obtained in a single cycle. In addition, single-line image data of the light reflected from the face B as a result of the single light emission can be obtained in each of Phases 1 and 3. These two single-line data are required for the generation of a subtracted reflective light image.

Note that in Phases 1 and 3, the first sensor 20 detects light reflected from the face B as a result of the single light emission, and the second sensor 30 detects transmissive light. Specifically, the phase for obtaining the transmissive light image is used to obtain the image of the light reflected from the face B as a result of the single light emission. That is, no additional phase is required. Therefore, the subtracted reflective light image, which is used for the detection of the wrinkles, can be generated without increasing the detection time and decreasing the resolution of other transmissive light images and reflective light images.

As can be seen, according to this embodiment, in a phase where one of the light emission units 22*a* and 22*b* of the first sensor 20 emits light and the optical sensor 21 detects the light reflected from the paper sheet BL, the light emission unit 24 of the first sensor 20 emits light, and the optical sensor 31 of the second sensor 30 detects light transmitted through the paper sheet BL. Thus, the light reflected as a result of the single light emission, which is required for the generation of a subtracted reflective light image used to recognize how much the paper sheet is wrinkled, can be detected simultaneously with the detection of the transmissive light. This can avoid the detection time from increasing, and the transport speed from decreasing.

The operations shown in FIGS. 4 and 5 are merely examples, and the present disclosure is not limited thereto. The same advantages as those of the present embodiment are obtained as long as the phase for obtaining the transmissive light image is used to obtain the image of light reflected from each of the faces through the single light emission. Alternatively, the phase for obtaining the transmissive light image may be used to obtain the image of light reflected from only one of the faces as a result of the single light emission. Further, in the operation example of FIG. 4, in two phases in each of which the image of light reflected from one of the faces as a result of the single light emission is obtained, transmissive light images of different wavelengths are obtained. For example, in the operation example of FIG. 4, the transmitted infrared light image is obtained in Phase 1, and the transmitted visible light image is obtained in Phase 2. In this way, various types of images used for the recognition of the paper sheets can be obtained efficiently.

Figure 6:
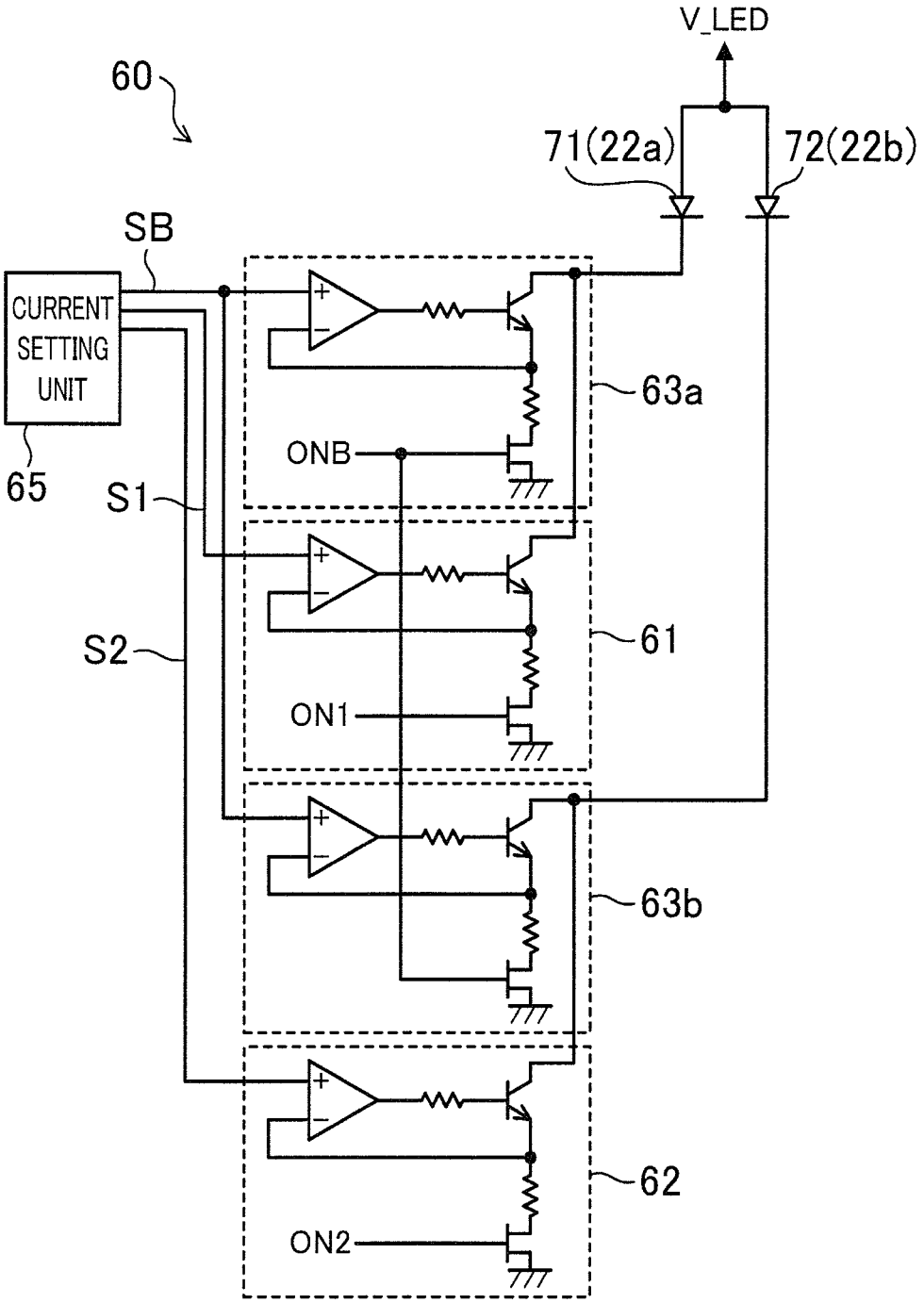
FIG. 6 is an exemplary configuration of a light emitting circuit controlling timing and amount of light emission from a light emission unit.

FIG. 6 illustrates an exemplary configuration of a light emission circuit 60. The light emission circuit 60 controls the timing and amount of light emission from the light emission units 22*a* and 22*b* of the first sensor 20 in accordance with an instruction signal from the light source controller 121. LEDs 71 and 72 are examples of the light sources of the light emission unit 22*a* and 22*b*, respectively. The light emission circuit 60 includes constant current circuits 61 and 63*a* driving the LED 71, and constant current circuits 62 and 63*b* driving the LED 72. The constant current circuit 61 operates in response to an on signal ON1. The constant current circuit 62 operates in response to an on signal ON2. The constant current circuits 63*a* and 63*b* simultaneously operate in response to an on signal ONB. The light emission circuit 60 includes a current setting unit 65 which sends a signal for setting an LED current. The current setting unit 65 sends a setting signal S1 to the constant current circuit 61, a setting signal S2 to the constant current circuit 62, and a setting signal SB to the constant current circuits 63*a* and 63*b*.

The constant current circuit 61, serving as a first circuit, operates in response to the on signal ON1 when the light emission unit 22*a* emits light and the light emission unit 22*b* emits no light, and allows a current of a value according to the setting signal S1 to flow through the LED 71. The constant current circuit 62, serving as a second circuit, operates in response to the on signal ON2 when the light emission unit 22*a* emits no light and the light emission unit 22*b* emits light, and allows a current of a value according to the setting signal S2 to flow through the LED 72. The constant current circuits 63*a* and 63*b*, serving as third circuits, operate in response to the on signal ONB when both of the light emission units 22*a* and 22*b* emit light, and allows a current of a value according to the setting signal SB to flow through the LEDs 71 and 72. The constant current circuits 63*a* and 63*b* are independent from the constant current circuits 61 and 62.

Thus, in the case where both of the light emission units 22*a* and 22*b* emit light, and the case where one of the light emission units 22*a* and 22*b* emits light, the light sources are driven by circuits independent from one another, and the amount of light emission can be controlled appropriately in either case. For example, if light is emitted from one of the light emission units 22*a* and 22*b*, its light source can be controlled to increase the light amount. If light is emitted from both of the light emission units 22*a* and 22*b*, their light sources can be controlled to reduce the light amount.

DESCRIPTION OF REFERENCE CHARACTERS

10 Line Sensor
20 First Sensor
21 First Optical Sensor
22*a* First Light Emission Unit
22*b* Second Light Emission Unit
24 Third Light Emission Unit
30 Second Sensor
31 Second Optical Sensor
32*a* Fourth Light Emission Unit
32*b* Fifth Light Emission Unit
41, 44 Light Guide
42, 43, 45, 46 Illuminator
50 Transport Path
60 Light Emission Circuit
61 Constant Current Circuit (First Circuit)
62 Constant Current Circuit (Second Circuit)
63*a*, 63*b* Constant Current Circuit (Third Circuit)
120 Sensor Controller
130 Image Data Generator
BL Paper Sheet
Z1 First Recognition Zone
Z2 Second Recognition Zone

The invention claimed is:

1. A paper sheet recognition apparatus, comprising:
a transport path on which paper sheets are transported;
a first sensor which is opposed to a first face of each paper sheet being transported, and performs detection in a first recognition zone of the transport path;
a second sensor which is opposed to a second face of each paper sheet being transported, and performs detection in a second recognition zone of the transport path; and
a sensor controller which controls the first and second sensors, wherein
the first sensor includes
a first light emission unit and a second light emission unit which emit rays of light from mutually different directions to the first recognition zone,
a first optical sensor which detects light reflected from the paper sheet in the first recognition zone, and
a third light emission unit which emits light to the second recognition zone,
the second sensor includes
a second optical sensor which detects light transmitted through the paper sheet in the second recognition zone,
the sensor controller controls operations of the first and second sensors, the operations being divided into a plurality of phases,
the plurality of phases includes
a first phase in which the first light emission unit emits light, the second light emission unit emits no light, and the first optical sensor detects reflective light, and
a second phase in which the first light emission unit emits no light, the second light emission unit emits light, and the first optical sensor detects reflective light, and
in at least one of the first phase or the second phase, the third light emission unit emits light, and the second optical sensor detects transmitted light.

2. The paper sheet recognition apparatus of claim 1, wherein
the third light emission unit is able to emit rays of light of different wavelengths, and
the sensor controller allows the third light emission unit to emit rays of light of mutually different wavelengths in the first and second phases, and allows the second optical sensor to detect transmitted light.

3. The paper sheet recognition apparatus of claim 1, further comprising:
an image data generator unit which generates an image of the paper sheet from outputs of the first and second sensors, wherein
the image data generator unit generates a first reflective light image from the output of the first sensor in the first phase and a second reflective light image from the output of the first sensor in the second phase, and generates a subtracted reflective light image from a difference between the first reflective light image and the second reflective light image.

4. The paper sheet recognition apparatus of claim 1, wherein
the second sensor further includes
a fourth light emission unit and a fifth light emission unit which emit rays of light in mutually different directions to the second recognition zone, and
the plurality of phases includes
a third phase in which the first and second light emission units emit light and the first optical sensor detects reflective light, and the fourth and fifth light emission units emit light and the second optical sensor detects reflective light.

5. The paper sheet recognition apparatus of claim 1, wherein
each of the first and second light emission units includes a light guide extending in a principal scanning direction of the first optical sensor, and illuminators respectively provided at ends of the light guide, the first and second light emission units being arranged in parallel with each other.

6. The paper sheet recognition apparatus of claim 1, wherein
each of the first and second light emission units includes a light guide extending in a principal scanning direction of the first optical sensor, and an illuminator provided at one of ends of the light guide, the first and second light emission units being arranged in parallel with each other, and the illuminators being arranged at the ends on the same side of the light guides.

7. The paper sheet recognition apparatus of claim 1, wherein
each of the first and second light emission units includes a light guide extending in a principal scanning direction of the first optical sensor, and an illuminator provided at one of ends of the light guide, the first and second light emission units being arranged in parallel with each other, and the illuminators being arranged at the ends on different sides of the light guides.

8. The paper sheet recognition apparatus of claim 1, further comprising a light emission circuit controlling timing and amount of light emission from each of the first and second light emission units, wherein the light emission circuit includes a first circuit which drives the first light emission unit when the first light emission unit emits light and the second light emission unit emits no light, and a second circuit which drives the second light emission unit when the first light emission unit emits no light and the second light emission unit emits light, and a third circuit which is independent from the first and second circuits, and drives the first and second light emission units when both of the first and second light emission units emit light.

9. The paper sheet recognition apparatus of claim 1, wherein the first and second light emission units emit infrared light in the first and second phases.

10. The paper sheet recognition apparatus of claim 1, wherein the paper sheets are banknotes.

11. A method for recognizing paper sheets using a paper sheet recognition apparatus, the paper sheet recognition apparatus including:

a first sensor which is opposed to a first face of each paper sheet being transported on a transport path for transporting the paper sheets, and performs detection in a first recognition zone of the transport path; and a second sensor which is opposed to a second face of each paper sheet being transported on the transport path, and performs detection in a second recognition zone of the transport path;

the first sensor includes a first light emission unit and a second light emission unit which emit rays of light in mutually different directions to the first recognition zone, a first optical sensor which detects light reflected from the paper sheet in the first recognition zone, and a third light emission unit which emits light to the second recognition zone, the second sensor includes a second optical sensor which detects light transmitted through the paper sheet in the second recognition zone, the method comprising:

a first step of allowing the first light emission unit to emit light, the second light emission unit to emit no light, and the first optical sensor to detect reflective light;

a second step of allowing the first light emission unit to emit no light, the second light emission unit to emit light, and the first optical sensor to detect reflective light; and a third step of allowing the third light emission unit to emit light, and the second optical sensor to detect transmitted light, the third step being performed simultaneously with at least one of the first step or the second step.

* * * * *